US010333257B2

(12) United States Patent
Tseng

(10) Patent No.: US 10,333,257 B2
(45) Date of Patent: Jun. 25, 2019

(54) SIGNAL CONNECTOR HAVING GROUNDING TERMINAL AND GROUND PIECE TOGETHER TO FORM A GROUNDING ELEMENT

(71) Applicant: SIMULA TECHNOLOGY INC., Taoyuan (TW)

(72) Inventor: Te-Chih Tseng, Taoyuan (TW)

(73) Assignee: SIMULA TECHNOLOGY INC., Taoyuan (TW)

( * ) Notice: Subject to any disclaimer, the term of this patent is extended or adjusted under 35 U.S.C. 154(b) by 0 days.

(21) Appl. No.: 15/713,764

(22) Filed: Sep. 25, 2017

(65) Prior Publication Data

US 2018/0366884 A1 Dec. 20, 2018

(30) Foreign Application Priority Data

Jun. 15, 2017 (TW) ..... 106120015 A

(51) Int. Cl.

| | |
|---|---|
| ***H01R 13/652*** | (2006.01) |
| ***H01R 13/6594*** | (2011.01) |
| ***H01R 13/6597*** | (2011.01) |
| ***H01R 12/70*** | (2011.01) |
| ***H01R 24/60*** | (2011.01) |
| ***H01R 13/6585*** | (2011.01) |
| ***H01R 12/00*** | (2006.01) |
| *H01R 12/72* | (2011.01) |

(52) U.S. Cl.

CPC ..... *H01R 13/6594* (2013.01); *H01R 12/00* (2013.01); *H01R 12/707* (2013.01); *H01R 13/6585* (2013.01); *H01R 13/6597* (2013.01); *H01R 24/60* (2013.01); *H01R 12/724* (2013.01); *H01R 13/652* (2013.01)

(58) Field of Classification Search

CPC ..... H01R 23/02; H01R 23/70; H01R 23/73; H01R 24/60; H01R 24/62; H01R 13/652; H01R 13/6594

USPC ..... 439/660, 607.35, 4, 108

See application file for complete search history.

(56) References Cited

U.S. PATENT DOCUMENTS

| | | | | |
|---|---|---|---|---|
| 8,968,031 | B2 * | 3/2015 | Simmel | H01R 13/659 439/660 |
| 9,281,626 | B2 * | 3/2016 | Lin | H01R 13/6581 |
| 9,437,980 | B2 * | 9/2016 | Ueda | H01R 13/6596 |
| 9,502,840 | B2 * | 11/2016 | Kao | H01R 24/60 |
| 9,755,336 | B2 * | 9/2017 | Cheng | H01R 12/712 |

(Continued)

*Primary Examiner* — Hien D Vu

(74) *Attorney, Agent, or Firm* — Bacon & Thomas, PLLC

(57) ABSTRACT

The present invention provides a signal connector having grounding terminals and ground piece together to form a grounding element, which includes a first terminal assembly, a second terminal assembly, and a ground piece inserted in an insulating base body and located between the first and second terminal assemblies; wherein, two metal plates are inserted in the insulating base body and in contact with the ground piece respectively with the top portions thereof exposed outside the top surface of the insulating base body to serve as first grounding terminals of the first terminal assembly, and the bottom portions of the two metal plates exposed outside the bottom surface of the insulating base body to serve as second grounding terminals of the second terminal assembly. The first and second grounding terminals, and the ground piece are able to form the grounding element together for providing a shielding effect.

15 Claims, 8 Drawing Sheets

(56) References Cited

U.S. PATENT DOCUMENTS 9,843,141 B2 * 12/2017 Peng ..... H01R 13/6581
9,917,405 B2 * 3/2018 Ju ..... H01R 13/6585

* cited by examiner

SIGNAL CONNECTOR HAVING GROUNDING TERMINAL AND GROUND PIECE TOGETHER TO FORM A GROUNDING ELEMENT

FIELD OF THE INVENTION

The present invention relates to a signal connector, especially a signal connector structure having the grounding terminals and the ground piece together to form a grounding element in order to further enhance the shielding effect.

BACKGROUND OF THE INVENTION

Generally, signal connectors refer to all connection elements and auxiliary accessories thereof used for the electrical signal and power applications. Signal connectors bridge all signals and their quality affects the electricity and signal transmission reliability. Furthermore, signal connectors are closely related to the operation of electronic systems. Following the ever advancing development of electronic technology, the signal connector has become an indispensable equipment for all kinds of electronic devices to transmit data and connect to other peripheral devices. Among the transmission specifications of many connectors, universal serial bus (USB) is the most popular one.

Currently, the USB specification will soon fully enter USB 3.1. In order to enhance the transmission speed, transmission signal type, convenience for plug and unplug, the industry further introduces "Type-C connector". The structure of Type-C connector has a significant change that is an "up-down symmetrical structure". Users no longer need to identify the up side and bottom side of the plug specifically and, instead, can simply insert the plug to the corresponding socket, allowing the behavior that users do by instinct. However, in order to allow the plug to be inserted without the need of flipping the up side or bottom side around, Type-C connector must be provided with two identical sets of connection terminals. In addition, in order to prevent interference between signals of two sets of terminals, a ground piece must be provided within the connector thus to separate these two sets of terminals.

As the current industrial trend focuses on the mainstream design of electronic devices that are light weighted, slim and small in size, such specification for Type-C connectors of USB 3.1 poses difficulty and new challenges for the production and assembly process. Especially, when the structure becomes smaller, the distance between terminals undoubtedly is shortened, resulting in the degradation of the shielding effect of the aforementioned ground piece. Therefore, how to further improve the connector structure is the important topic that the present invention intends to solve.

SUMMARY OF THE INVENTION

The first objective of the present invention is to provide a signal connector having the grounding terminals and the ground piece together to form a grounding element. The signal connector includes a metal housing, an insulating base body, a first terminal assembly, a second terminal assembly and a ground piece, wherein the first terminal assembly, the second terminal assembly and the ground piece are inserted in the insulating base body; the ground piece is located at the location between the first terminal assembly and the second terminal assembly. The front end of the first terminal assembly is exposed outside the top surface of the insulating base body; the front end of the second terminal assembly is exposed outside the bottom surface of the insulating base body. The features of the signal connector include two metal plates inserted in the insulating base body and having in contact with the ground piece separately, wherein the top portions of the two metal plates are exposed outside the top surface of the insulating base body to respectively serve as a first grounding terminal located at the outmost positions of both sides of the first terminal assembly; the bottom portions of the two metal plates are exposed outside the bottom surface of the insulating base body to respectively serve as a second grounding terminal located at the outmost positions of both sides of the second terminal assembly. Therefore, the first grounding terminals, the second grounding terminals and the ground piece together can form a grounding element to create a more complete shielding effect and interference prevention of high frequency signals between the terminal assemblies.

The second objective of the present invention is to provide the aforementioned signal connector without the two metal plates and, instead, having the following structure. In other words, the top surface of the ground piece is mounted with two upper metal pieces and the bottom surface of the ground piece is mounted with two lower metal pieces, wherein the top portions of the two upper metal pieces are exposed outside the top surface of the insulating base body to respectively serve as a first grounding terminal located at the outmost positions of both sides of the first terminal assembly; the bottom portions of the two metal pieces are exposed outside the bottom surface of the insulating base body to respectively serve as a second grounding terminal located at the outmost positions of both sides of the second terminal assembly.

The third objective of the present invention is to provide a signal connector having the grounding terminals and the ground piece together to form a grounding element. The signal connector includes a metal housing, an insulating base body, a first terminal assembly, a second terminal assembly and a ground piece, wherein the first terminal assembly, the second terminal assembly and the ground piece are inserted in the insulating base body; the ground piece is located at the location between the first terminal assembly and the second terminal assembly. The front end of the first terminal assembly is exposed outside the top surface of the insulating base body; two first terminals located at the outmost positions of both sides of the first terminal assembly respectively to serve as the first grounding terminals. The front end of the second terminal assembly is exposed outside the bottom surface of the insulating base body; two second terminals located at the outmost positions of both sides of the second terminal assembly respectively to serve as the second grounding terminals. The features of the signal connector include that the top surface of the ground piece is mounted with two upper metal pieces; the bottom surface of the ground piece is mounted with two lower metal pieces, wherein the two upper metal pieces are electrically connected to the corresponding first grounding terminals respectively; the two lower metal pieces are electrically connected to the corresponding second grounding terminals respectively.

The fourth objective of the present invention is to provide the aforementioned signal connector without the two upper metal pieces and the two lower metal pieces, instead, having the following structure. In other words, two metal plates are inserted in the insulating base body and in contact with the ground piece separately, wherein the top portions of the two metal plates are exposed outside the top surface of the insulating base body and respectively connected to the corresponding first grounding terminals; the bottom portions of the two metal plates are exposed outside the bottom surface of the insulating base body to respectively connected to the corresponding second grounding terminals.

BRIEF DESCRIPTION OF THE DRAWINGS

The objectives, technical features, and effects of the present invention can be better understood by referring to the following detailed description of some illustrative embodiments in conjunction with the accompanying drawings, in which.

DETAILED DESCRIPTION OF THE PREFERRED EMBODIMENTS

Figure 1:
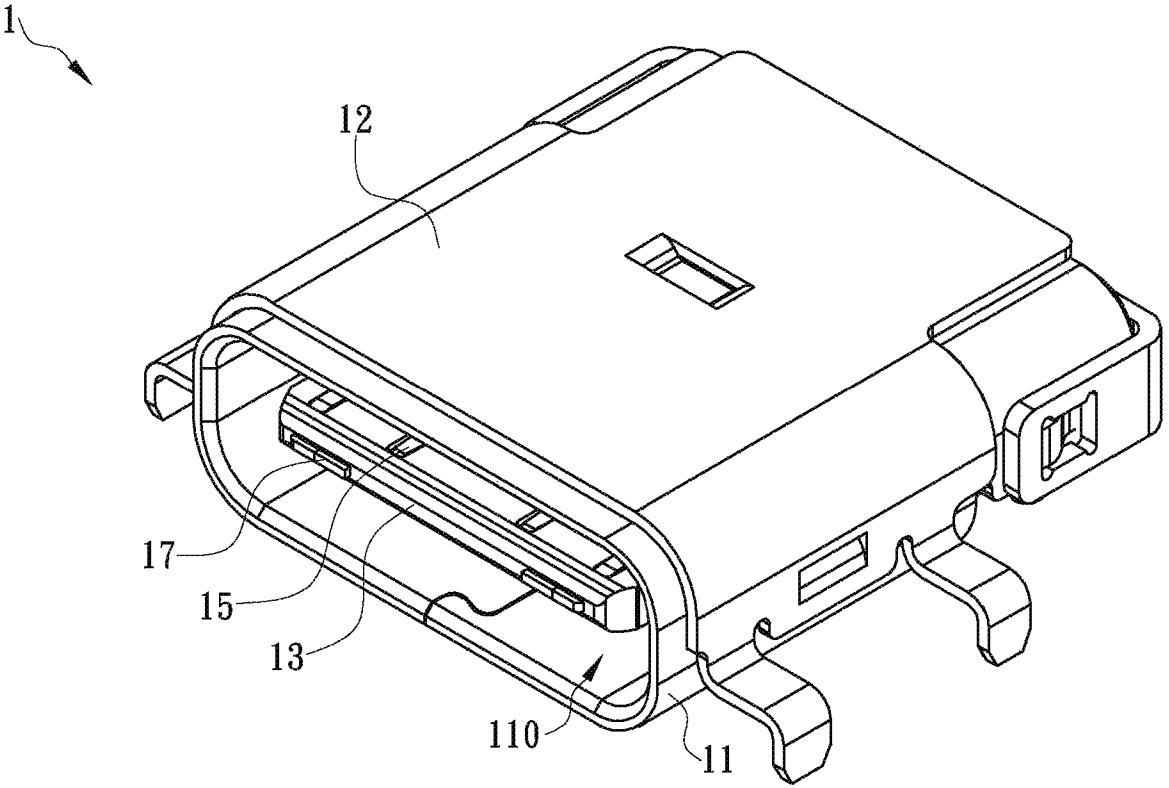
FIG. 1 is a schematic diagram of the appearance of the signal connector of the present invention.

The present invention relates to a signal connector having the grounding terminals and the ground piece together to form a grounding element. Please refer to FIG. 1. The signal connector 1 can be a Type-C specification of Universal Serial Bus (USB). The signal connector 1 of USB Type-C specification has grounding terminals located at the outmost positions of both sides of all terminals. Therefore, based on the aforementioned features, the following design structures of the present invention are created. Please refer to FIG. 1 to FIG. 4. In the first embodiment, the signal connector 1 includes at least a metal housing 11, an insulating base body 13, a first terminal assembly 15, a second terminal assembly 16, a ground piece 17, and two metal plates 19, wherein the metal housing 11 is provided with a receiving space 110 therewithin; the insulating base body 12 is assembled in the receiving space 110. However, in other embodiments of the present invention, manufacturers can also adjust the appearance of the mental housing 11, or add other metal item 12 on the metal housing 11 according to the requirements of production or design in order to enhance the overall structural strength, grounding effect or electromagnetic shielding effect of the signal connector 1.

Figure 2:
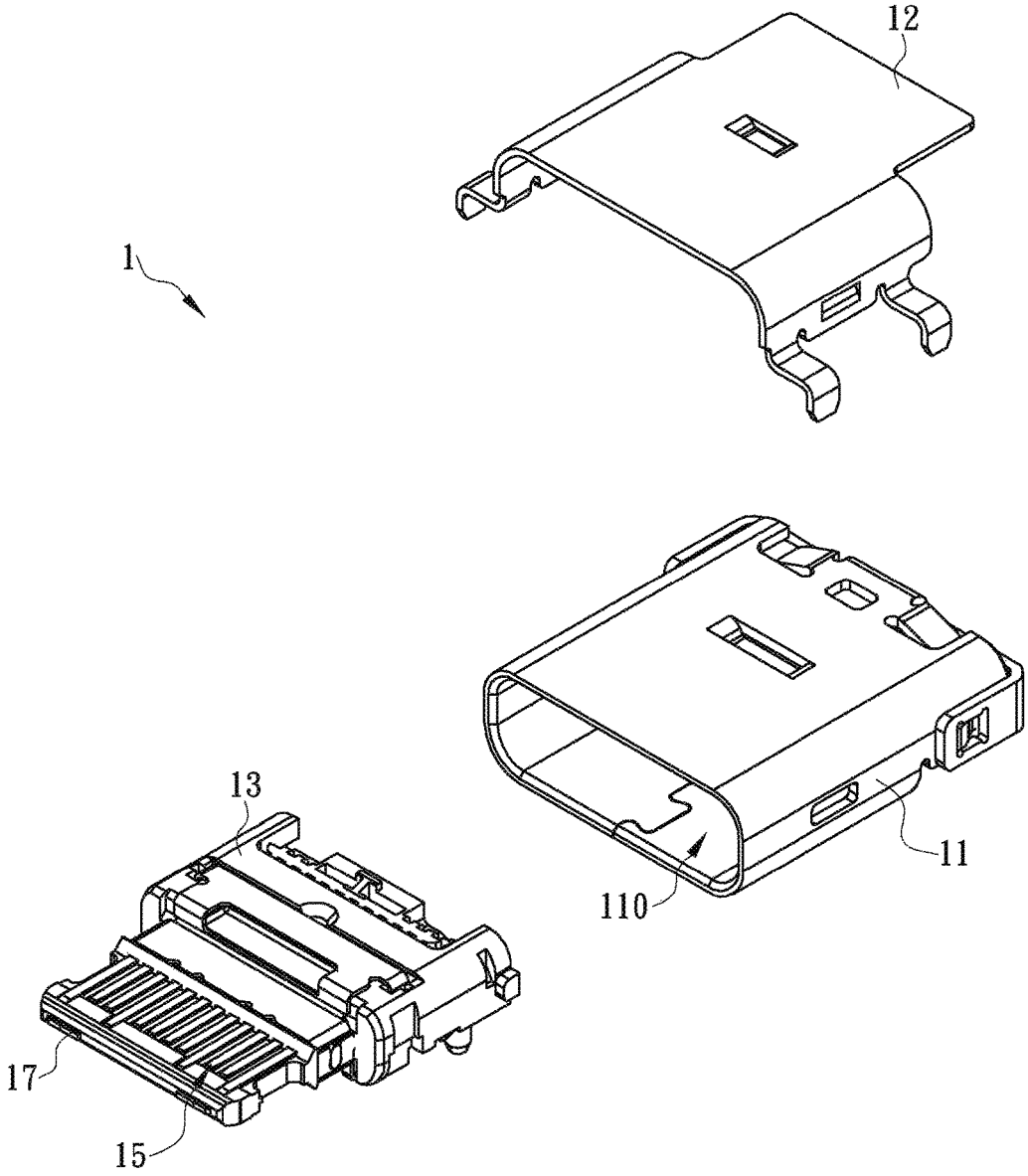
FIG. 2 is a composite schematic diagram of the signal connector of the present invention.
Figure 3:
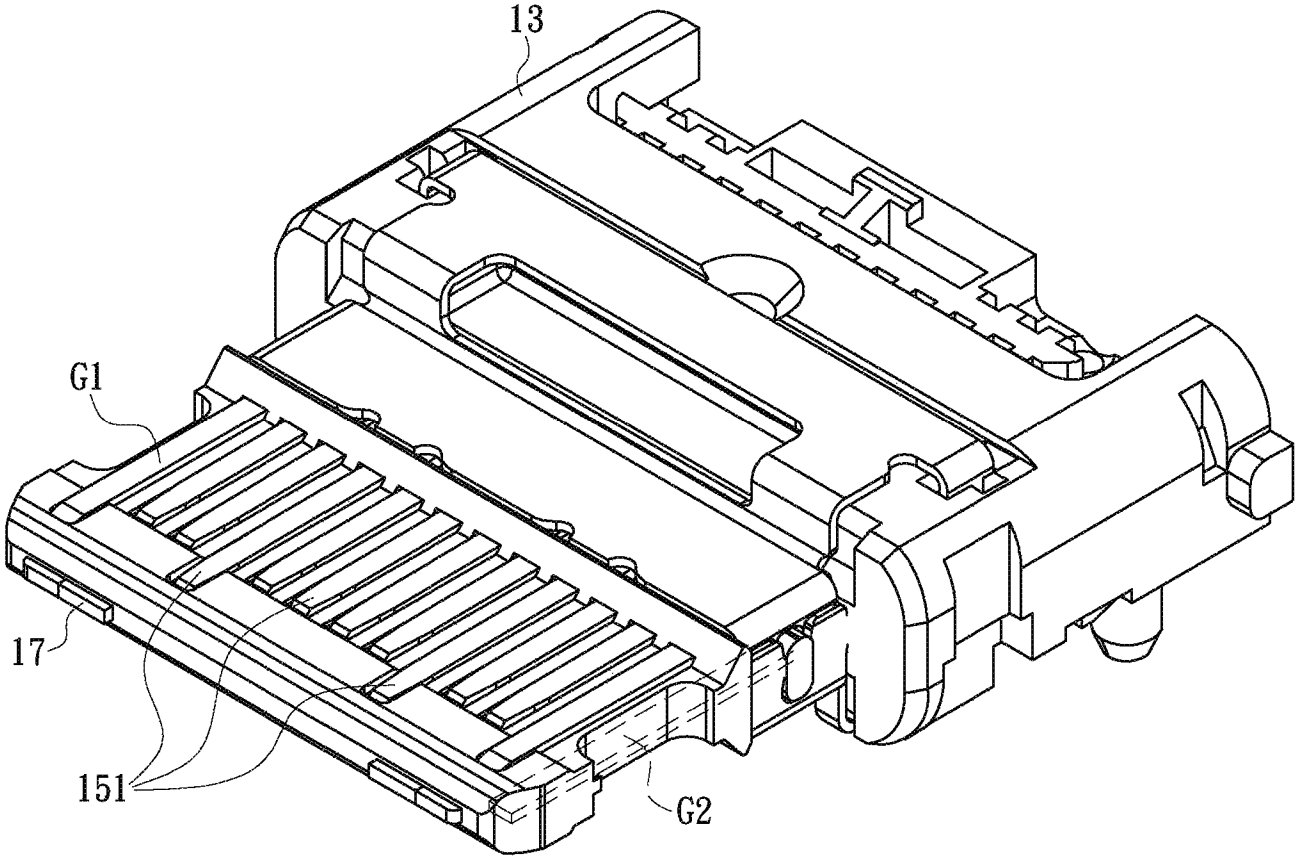
FIG. 3. is the schematic diagram of the insulating base body and the terminal assemblies of the signal connector of the present invention.
Figure 4:
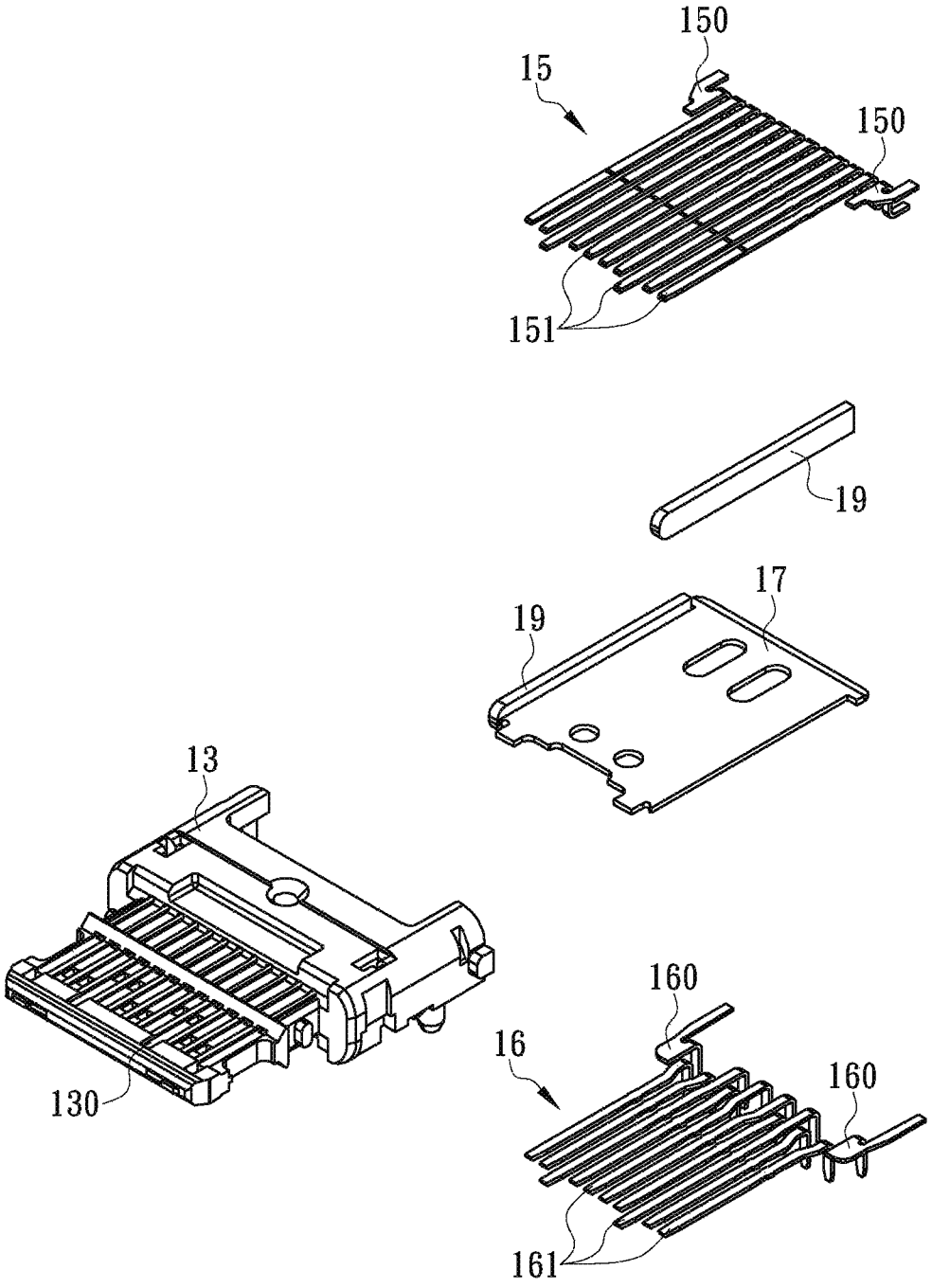
FIG. 4 is the explored view of partial elements of the first embodiment of the signal connector of the present invention.

Please refer to FIG. 1 to FIG. 4 again. In the first embodiment, the insulating base body 13 can be composed of one single element or multiple elements, wherein the front end of the insulating base body 13 can extend to form a shape of a tongue piece. At the locations adjacent to the top portion and the bottom portion of the insulating base body 13 is separately provided with a plurality of terminal slots 130 (FIG. 4 only illustrates the terminal slots 130 adjacent to the top portion of the insulating base body 13) for inserting the first terminal assembly 15 and the second terminal assembly 16. However, it shall be explained in advance that in other embodiments of the present invention, manufacturers can also mount the first terminal assembly 15 and the second terminal assembly 16 to the insulating base body 13 by performing multiple injection molding manufacturing processes. In addition, the first terminal assembly 15 comprises a plurality of first terminals 151. Each of the first terminals 151 is inserted to the corresponding terminal slot 130. The front end of the first terminal rests at the location of the front end (i.e. tongue piece) of the insulating base body 13 and is exposed outside the top surface of the insulating base body 13. When the user inserts the other signal connector into the signal connector 1, the other first terminal assembly of the other signal connector can be electrically connected to the first terminal assembly 15 in order to transmit signals to each other. Furthermore, the rear end of the first terminal 151 extends outside the insulating base body 13 in order to be welded to the corresponding circuit of the circuit board (not shown in the diagram).

Again, please refer to FIG. 1 to FIG. 4. In the first embodiment, the second terminal assembly 16 comprises a plurality of second terminals 161, wherein the second terminal 161 is inserted to the corresponding terminal slot 130. The front end of the second terminal rests at the location of the front end (i.e. tongue piece) of the insulating base body 13 and is exposed outside the bottom surface of the insulating base body 13. When the user inserts the other signal connector into the signal connector 1, the other second terminal assembly of the other signal connector can be electrically connected to the second terminal assembly 16 in order to transmit signals to each other. The rear end of the second terminal 161 extends outside the insulating base body 13 in order to be welded to the corresponding circuit of the circuit board. Furthermore, in the first embodiment, the ground piece 17 can be mounted directly in the insulating base body 13 by the injection molding manufacturing process and is located in the gap of the insulating base body 13 corresponding to the location between the first terminal assembly 15 and the second terminal assembly 16 in order to prevent interference between signals transmitted by the first terminal assembly 15 and the second terminal assembly 16.

Please refer to FIG. 1 to FIG. 4 for the illustration of the first embodiment again. The two metal plates 19 are inserted in the insulating base body 13 and the side edges of the middle portions of the metal plates are respectively in contact with the side edges of the ground piece 17 to form an electrical connection, wherein the top portions of the two metal plates 19 are exposed outside the top surface of the insulating base body 13 to respectively serve as a first grounding terminal G1 located at the outmost positions of both sides of the first terminal assembly 15 (as shown in FIG. 3); the bottom portions of the two metal plates 19 are exposed outside the bottom surface of the insulating base body 13 to respectively serve as a second grounding terminal G2 located at the outmost positions of both sides of the second terminal assembly 16 (as shown in FIG. 3). Therefore, the first grounding terminals G1, the second grounding terminals G2 and the ground piece 17 together can be electrically connected to one another and form a grounding element to create a more complete shielding effect and interference prevention of high frequency signals between the first terminal assembly 15 and the second terminal assembly 16. However, it shall be explained in advance that even though the first grounding terminal G1 and the second grounding terminal G2 are illustrated in FIG. 3 respectively, it is simply a form of illustration of how the first grounding terminal G1 and the second grounding terminal G2 are exposed outside the insulating base body 13. In the case of the first embodiment, the first ground terminal G1 and the second grounding terminal G2 are the top portion and the bottom portion of the metal plate 19 respectively.

Please refer to FIG. 1 to FIG. 4 again. In the first embodiment, the first terminal assembly 15 also includes two first grounding soldering portions 150, wherein each first grounding soldering portion 150 is respectively located at the outmost positions of both sides of the first terminal assembly 15; the front end thereof is in contact with the top portion of the corresponding metal plate 19; the rear end thereof extends outside the insulating base body 13 in order to be welded to the grounding circuit of the circuit board. Thus, the top portion of the metal plate 19, the first grounding soldering portion 150 can form a first grounding terminal G1. Furthermore, the second terminal assembly 16 also includes two second grounding soldering portion 160, wherein each second grounding soldering portion 160 is respectively located at the outmost positions of both sides of the second terminal assembly 16; the front end thereof is in contact with the bottom portion of the corresponding metal plate 19; the rear end thereof extends outside the insulating base body 13 in order to be welded to the grounding circuit of the circuit board. Thus, the bottom portion of the metal plate 19, the second grounding soldering portion 160 can form a second grounding terminal G2. Thus, the signal connector 1 of the present invention completely meets the USB Type-C specification.

In additional to the aforementioned structure of the signal connector, manufacturers can also adjust some elements of the signal connector. In the following embodiments, descriptions are given only for elements that have changed; descriptions for those elements whose structures and connections with respect to other parts remain unchanged will not be repeated. For the second embodiment of the present invention, please refer to FIG. 5. The insulating base body 23 is assembled inside the metal housing 11, shown in FIG. 4, and locations adjacent to the top portion and the bottom portion thereof are provided with a plurality of terminal slots 230 respectively. The terminal slots 230 adjacent to the top portion of the insulating base body 23 are inserted with a plurality of first terminals 251 of the first terminal assembly 25, wherein the front end of each first terminal 251 is exposed outside the top surface of the insulating base body 23; the rear end of each first terminal 251 extends outside the insulating base body 23. The terminal slots 230 adjacent to the bottom of the insulating base body 23 are inserted with a plurality of second terminals 261 of the second terminal assembly 26, wherein the front end of each second terminal 261 is exposed outside the bottom surface of the insulating base body 23; the rear end of each second terminal 251 extends outside the insulating base body 23.

Please refer to FIG. 5 again. In the second embodiment, the insulating base body 23 is inserted with a ground piece 27 therein. The ground piece 27 is located between the first terminal assembly 25 and the second terminal assembly 26; the top surface of the ground piece 27 is mounted with two upper metal pieces 29A, wherein the top portions of the two upper metal pieces 29A are exposed outside the top surface of the insulating base body 23 to respectively serve as a first grounding terminal G1 located at the outmost positions of both sides of the first terminal assembly 25 (as shown in FIG. 3). The bottom surface of the ground piece 27 is mounted with two lower metal pieces 29B, wherein the bottom portions of the two lower metal pieces 29B are exposed outside the bottom surface of the insulating base body 23 to respectively serve as a second grounding terminal G2 located at the outmost positions of both sides of the second terminal assembly 26 (as shown in FIG. 3). Therefore, the first grounding terminals G1, the second grounding terminals G2, and the ground piece 27 are together to form a grounding element. Especially, the upper metal pieces 29A and the lower metal pieces 29B can be mounted fixedly to the ground piece 27 by the method of welding or clamping, or by installing on the ground piece 27 through being made as one piece, so long as that the upper metal pieces 29A and the lower metal pieces 29B can be electrically connected to the ground piece 27.

Figure 5:
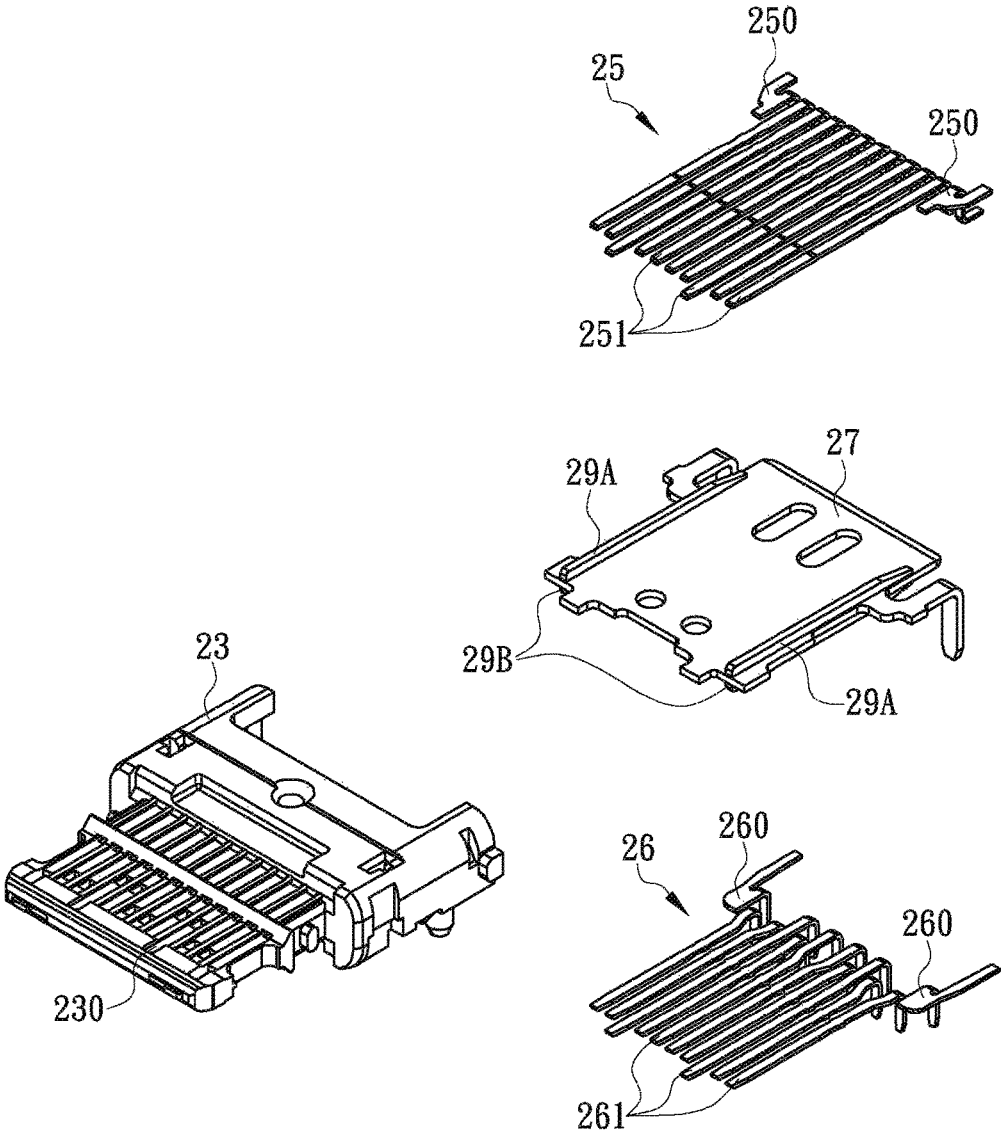
FIG. 5 is the explored view of partial elements of the second embodiment of the signal connector of the present invention.

Please refer to FIG. 5 for the second embodiment. In the second embodiment, the first terminal assembly 25 also includes two first grounding soldering portions 250, wherein each first grounding soldering portion 250 respectively is located at the outmost position of both sides of the first terminal assembly 25; the front end thereof is in contact with the corresponding upper metal piece 29A; the rear end thereof extends outside the insulating base body 23 in order to be welded to the grounding circuit of the circuit board. The second terminal assembly 26 also includes two second grounding soldering portions 260, wherein each second grounding soldering portion 260 respectively is located at the outmost position of both sides of the second terminal assembly 26; the front end thereof is in contact with the corresponding lower metal piece 29B; the rear end thereof extends outside the insulating base body 23 in order to be welded to the grounding circuit of the circuit board.

Figure 6:
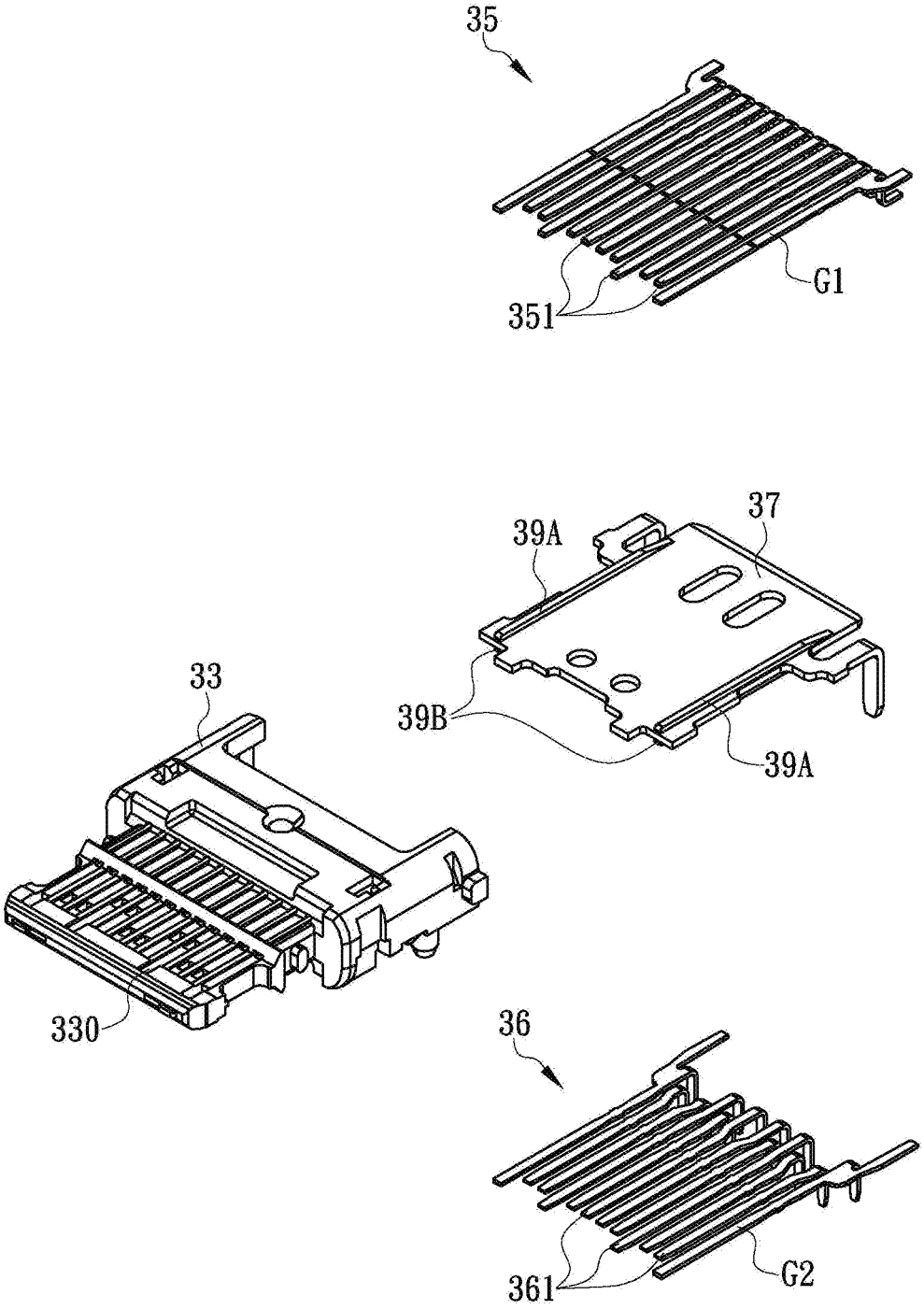
FIG. 6 is the explored view of partial elements of the third embodiment of the signal connector of the present invention.

For the third embodiment of the present invention, please refer to FIG. 6. The insulating base body 33 is assembled inside the metal housing 11, shown in FIG. 4, and locations adjacent to the top portion and the bottom portion thereof are provided with a plurality of terminal slots 330 respectively. The terminal slots 330 adjacent to the top portion of the insulating base body 33 are inserted with a plurality of first terminals 351 of the first terminal assembly 35, wherein the front end of each first terminal 351 is exposed outside the top surface of the insulating base body 33; the rear end of each first terminal 351 extends outside the insulating base body 33. The terminal slots 330 adjacent to the bottom of the insulating base body 33 are inserted with a plurality of second terminals 361 of the second terminal assembly 36, wherein the front end of each second terminal 361 is exposed outside the bottom surface of the insulating base body 33; the rear end of each second terminal 351 extends outside the insulating base body 33. One difference between the third embodiment and the second embodiment is that the two first terminals 351 located at the outmost positions of both sides of the first terminal assembly 35 respectively are to serve as a first grounding terminal G1 respectively and the rear end of each first grounding terminal G1 can be welded to the grounding circuit of the circuit board; the two second terminals 361 located at the outmost positions of both sides of the second terminal assembly 36 respectively are to serve as a second grounding terminal G2 respectively and the rear end of each second grounding terminal G2 can be welded to the grounding circuit of the circuit board.

Figure 7:
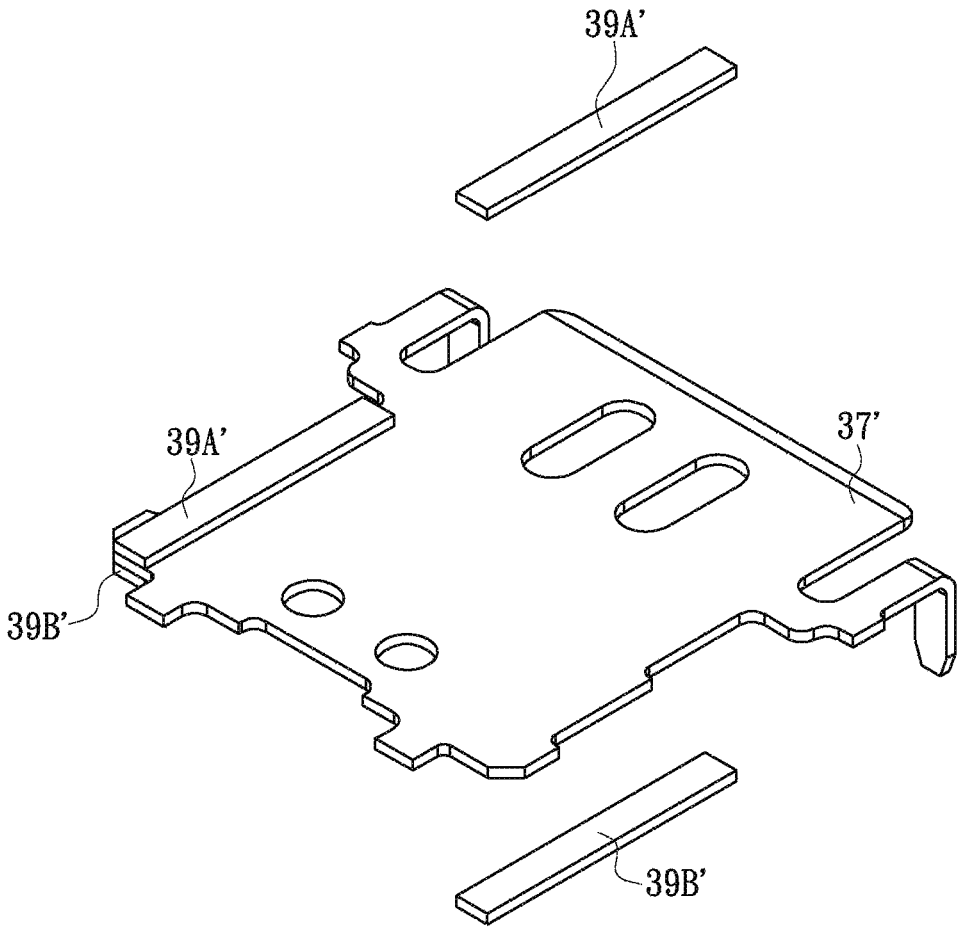
FIG. 7 is the explored view of partial elements of the fourth embodiment of the signal connector of the present invention.

Please refer to FIG. 6 again. In the third embodiment, the insulating base body 33 is inserted with a ground piece 37 therein. The ground piece 37 is located between the first terminal assembly 35 and the second terminal assembly 36; the top surface of the ground piece 37, corresponding to the position of each first grounding terminal G1, is mounted with two upper metal pieces 39A; the bottom surface of the ground piece 37, corresponding to the position of each second grounding terminal G2, is mounted with two lower metal pieces 39B. When the first terminal assembly 35 and the second terminal assembly 36 are inserted to the insulating base body 33, each first grounding terminal G1 is electrically connected to the corresponding upper metal piece 39A; each second grounding terminal G2 is electrically connected to the corresponding lower metal piece 39B, so that the first grounding terminals G1, the second grounding terminals G3, and the ground piece 37 together form a grounding element. Furthermore, please refer to FIG. 6 for the illustration of the third embodiment. Each upper metal piece 39A and each lower metal piece 39B are made in one piece to be provided on the ground piece 37. However, it shall be explained in advance that in the fourth embodiment of the present invention, as illustrated in FIG. 7, the upper metal pieces 39A' and the lower metal pieces 39B' can be welded on to the ground piece 37'; the upper metal pieces 39A' and the lower metal pieces 39B' can be changed to be in a flat plate shape, without being limited to the long strip shape as shown in FIG. 6.

Figure 8:
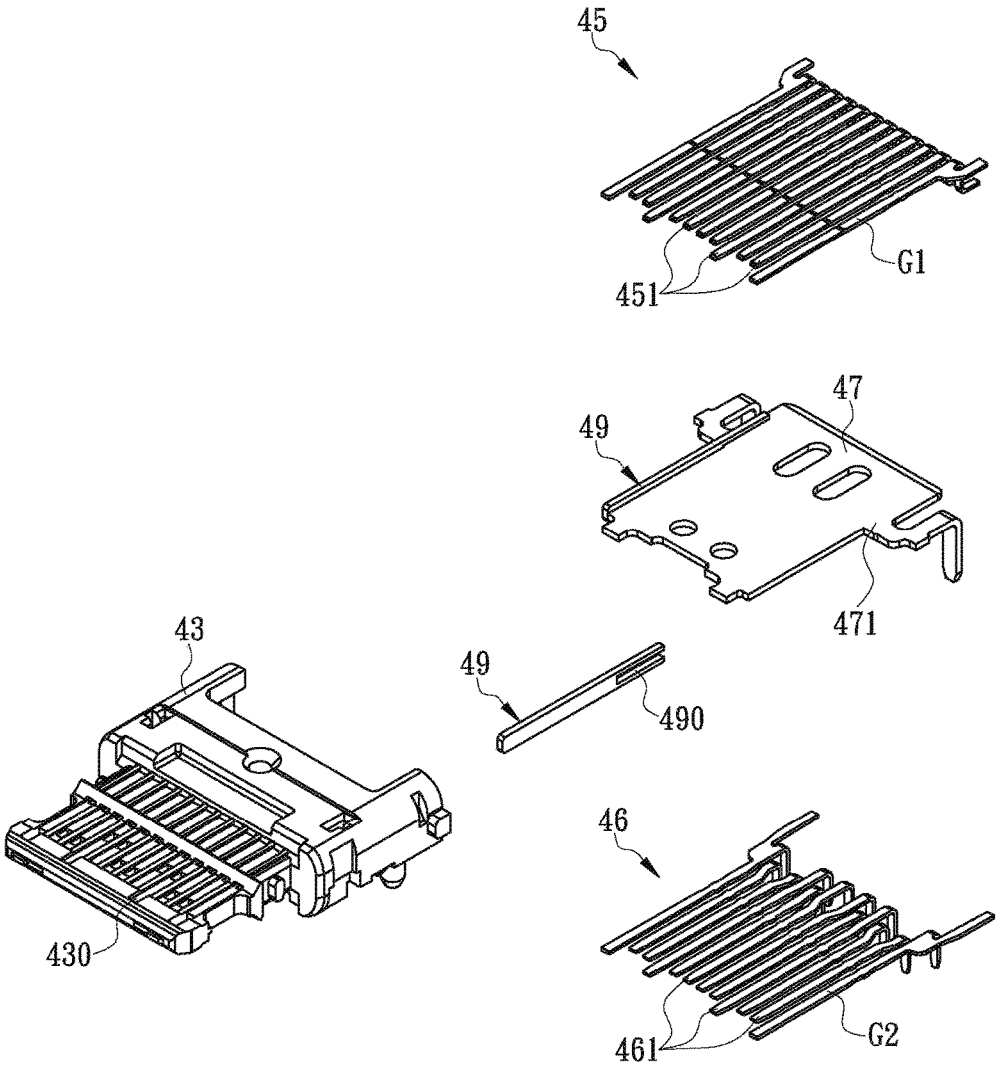
FIG. 8 is the explored view of partial elements of the fifth embodiment of the signal connector of the present invention.

Please refer to FIG. 8 for the fifth embodiment of the present invention. The insulating base body 43 is assembled inside the metal housing 11, shown in FIG. 4, and locations adjacent to the top portion and the bottom portion thereof are provided with a plurality of terminal slots 430 respectively. The terminal slots 430 adjacent to the top portion of the insulating base body 43 are inserted with a plurality of first terminals 451 of the first terminal assembly 45, wherein the two first terminals 451 located at the outmost positions of both sides of the first terminal assembly 45 respectively are to serve as a first grounding terminal G1 respectively; the front end of each first terminal 451 is exposed outside the top surface of the insulating base body 43 and the rear end of each first terminal 451 extends outside the insulating base body 43. The terminal slots 430 adjacent to the bottom portion of the insulating base body 43 are inserted with a plurality of second terminals 461 of the second terminal assembly 46, wherein the two second terminals 461 located at the outmost positions of both sides of the second terminal assembly 46 respectively are to serve as a second grounding terminal G2 respectively; the front end of each second terminal 461 is exposed outside the bottom surface of the insulating base body 43 and the rear end of each second terminal 461 extends outside the insulating base body 43.

Please refer to FIG. 8 again. In the fifth embodiment, the insulating base body 43 is inserted with a ground piece 47 therein. The ground piece 47 is located between the first terminal assembly 45 and the second terminal assembly 46; the ground piece 47 is assembled with two metal plates 49. When the two metal plates 49 and the ground piece 47 are assembled together inside the insulating base body 43, the top portions of two metal plates 49 are exposed outside the top surface of the insulating base body 43 and electrically connected to the corresponding first grounding terminals G1 respectively. The bottom portions of two metal plates 49 are exposed outside the bottom surface of the insulating base body 43 and electrically connected to the corresponding second grounding terminals G2 respectively. Therefore, the first grounding terminals G1, the second grounding terminals G2, and the ground piece 47 together form a grounding element. In the fifth embodiment, the rear ends of two metal plates 49 have a holding hole 490 respectively and the ground piece 47 has a protruding part 471 at the location corresponding to each holding hold 490 respectively. When the ground piece 47 and the metal plates 49 are assembled into one piece, each protruding part 471 can be inserted into the corresponding holding hole 490 respectively so that the two metal plates 49 and the ground piece 47 are electrically connected to each other. However, in other embodiments of the present invention, manufacturers may adjust or change the insertion structure between the metal plates 49 and the ground piece 47, based on the actual requirements.

While the invention herein disclosed has been described by means of specific embodiments, numerous modifications and variations could be made thereto by those skilled in the art without departing from the scope of the invention set forth in the claims.

What is claimed is:

1. A signal connector having ground terminals and a ground piece together to form a ground element, comprising:

a metal housing, wherein a receiving space is provided therewithin;

an insulating base body, disposed in the receiving space of the metal housing;

a first terminal assembly, including a plurality of first terminals, wherein each first terminal is provided on the insulating base body; a front end of each first terminal is exposed outside a top surface of the insulating base body in order to be electrically connected to another first terminal assembly of another signal connector; a rear end of each first terminal extends outside the insulating base body in order to be welded to a circuit board;

a second terminal assembly, including a plurality of second terminals, wherein each second terminal is provided on the insulating base body; a front end of each second terminal is exposed outside a bottom surface of the insulating base body in order to be electrically connected to another second terminal assembly of another signal connector; a rear end of each second terminal extends outside the insulating base body in order to be welded to a circuit board;

a ground piece, located inside the insulating base body between the first terminal assembly and the second terminal assembly; and the signal connector further including:

two metal plates inserted in the insulating base body and having in contact with the ground piece separately, wherein the top portions of the two metal plates are exposed outside a top surface of the insulating base body to respectively serve as a first ground terminal disposed at outmost positions of each side of the first terminal assembly; bottom portions of the two metal plates are exposed outside a bottom surface of the insulating base body to respectively serve as a second ground terminal disposed at outmost positions of each side of the second terminal assembly; therefore, the first ground terminals, the second ground terminals and the ground piece get together to form a ground element;

wherein the first terminal assembly also includes two first ground soldering portions, wherein each first ground soldering portion is respectively disposed at the outmost positions of each side of the first terminal assembly; a front end thereof is in contact with a top portion of a corresponding metal plate; a rear end thereof extends outwardly outside the insulating base body in order to be welded to the ground circuit of a circuit board.

2. The signal connector as claimed in claim 1, wherein the second terminal assembly also includes two second ground soldering portions, wherein each second ground soldering portion is respectively disposed at the outmost positions of each side of the first terminal assembly; a front end thereof is in contact with a bottom portion of a corresponding metal plate; a rear end thereof extends outside the insulating base body in order to be welded to the ground circuit of the circuit board.

3. The signal connector as claimed in claim 2, wherein the signal connector is a Type-C specification of Universal Serial Bus (USB).

4. A signal connector having ground terminals and a ground piece together to form a ground element, at least comprising:

a metal housing, wherein a receiving space is provided therewithin;

an insulating base body, disposed in the receiving space of the metal housing;

a first terminal assembly, including a plurality of first terminals, wherein each first terminal is provided on the insulating base body; a front end of each first terminal is exposed outside a top surface of the insulating base body in order to be electrically connected to another first terminal assembly of another signal connector; a rear end of each first terminal extends outside the insulating base body in order to be welded to a circuit board;

a second terminal assembly, including a plurality of second terminals, wherein each second terminal is provided on the insulating base body; a front end of each second terminal is exposed outside a bottom surface of the insulating base body in order to be electrically connected to another second terminal assembly of another signal connector; a rear end of each second terminal extends outside the insulating base body in order to be welded to the circuit board;

a ground piece, disposed inside the insulating base body between the first terminal assembly and the second terminal assembly; and the signal connector further including:

two upper metal pieces, inserted in the insulating base body and mounted to a top surface of the ground piece respectively, wherein top portions of the two upper metal pieces are exposed outside the top surface of the insulating base body to respectively serve as a first ground terminal disposed at outmost positions of each side of the first terminal assembly; and two lower metal pieces, inserted in the insulating base body and mounted to a bottom surface of the ground piece respectively, wherein bottom portions of the two lower metal pieces are exposed outside the bottom surface of the insulating base body to respectively serve as a second ground terminal disposed at outmost positions of each side of the second terminal assembly; thus, the first ground terminals, the second ground terminals, and the ground piece get together to form a ground element of the signal connector;

wherein the first terminal assembly also includes two first ground soldering portions, wherein each first ground soldering portion is respectively disposed at the outmost positions of each side of the first terminal assembly; a front end thereof is in contact with a top portion of a corresponding upper metal piece respectively; a rear end thereof extends outwardly outside the insulating base body in order to be welded to a ground circuit of the circuit board.

5. The signal connector as claimed in claim 4, wherein the second terminal assembly also includes two second ground soldering portions, wherein each second ground soldering portion is respectively disposed at the outmost positions of each side of the second terminal assembly; a front end thereof is in contact with a bottom portion of the corresponding lower metal piece respectively; a rear end thereof extends outside the insulating base body in order to be welded to the ground circuit of the circuit board.

6. The signal connector as claimed in claim 5, wherein the signal connector is a Type-C specification of Universal Serial Bus (USB).

7. The signal connector as claimed in claim 6, wherein the upper metal pieces and the lower metal pieces are mounted on to the ground piece by the method of welding.

8. The signal connector as claimed in claim 6, wherein each upper metal piece, each lower metal piece, and the ground piece are made in one piece.

9. A signal connector having the ground terminals and the ground piece together to form a ground element, at least comprising:

a metal housing, wherein a receiving space is provided therewithin;

an insulating base body, disposed in the receiving space of the metal housing;

a first terminal assembly, including a plurality of first terminals, wherein each first terminal is provided on the insulating base body; a front end of each first terminal is exposed outside a top surface of the insulating base body in order to be electrically connected to another first terminal assembly of another signal connector; a rear end of each first terminal extends outside the insulating base body in order to be welded to a circuit board, wherein two first terminals disposed at outmost positions of both sides of the first terminal assembly respectively are to serve as a first ground terminal respectively and a rear end of each first terminal can be welded to a ground circuit of the circuit board;

a second terminal assembly, including a plurality of second terminals, wherein each second terminal is provided on the insulating base body; a front end of each second terminal is exposed outside the bottom surface of the insulating base body in order to be electrically connected to another second terminal assembly of another signal connector; a rear end of each second terminal extends outside the insulating base body in order to be welded to a circuit board, wherein two second terminals disposed at outmost positions of each side of the second terminal assembly respectively are to serve as a second ground terminal respectively and the rear end of each second terminal having a ground soldering portion extended outwardly to be welded to the ground circuit of the circuit board;

a ground piece, disposed inside the insulating base body between the first terminal assembly and the second terminal assembly; wherein:

locations on a top surface of the ground piece corresponding to two first ground terminals are mounted with an upper metal piece respectively, wherein the two upper metal pieces are electrically connected to the corresponding first ground terminals respectively; and locations on a bottom surface of the ground piece corresponding to two second ground terminals are mounted with a lower metal piece respectively, wherein the two lower metal pieces are electrically connected to the corresponding second ground terminals respectively; therefore, the first ground terminals, the second ground terminals, and the ground piece get together to form a ground element of the signal connector.

10. The signal connector as claimed in claim 9, wherein the signal connector is a Type-C specification of Universal Serial Bus (USB).

11. The signal connector as claimed in claim 10, wherein the upper metal pieces and the lower metal pieces are mounted on to the ground piece by the method of welding.

12. The signal connector as claimed in claim 10, wherein each upper metal piece, each lower metal piece, and the ground piece are made in one piece.

13. A signal connector having the ground terminals and the ground piece together to form a ground element, at least comprising:

a metal housing, wherein a receiving space is provided therewithin;

an insulating base body, located in the receiving space of the metal housing;

a first terminal assembly, including a plurality of first terminals, wherein each first terminal is provided on the insulating base body; the front end of each first terminal is exposed outside a top surface of the insulating base body in order to be electrically connected to another first terminal assembly of another signal connector; a rear end of each first terminal extends outside the insulating base body in order to be welded to a circuit board, wherein two first terminals disposed at outmost positions of both sides of the first terminal assembly respectively are to serve as a first ground terminal respectively and a rear end of each first terminal can be welded to the ground circuit of the circuit board;

a second terminal assembly, including a plurality of second terminals, wherein each second terminal is provided on the insulating base body; a front end of each second terminal is exposed outside a bottom surface of the insulating base body in order to be electrically connected to another second terminal assembly of another signal connector; a rear end of each second terminal extends outside the insulating base body in order to be welded to a circuit board, wherein two second terminals disposed at outmost positions of both sides of the second terminal assembly respectively are to serve as a second ground terminal respectively and the rear end of each second terminal having a ground soldering portion extended outwardly to be welded to the ground circuit of the circuit board;

a ground piece, disposed inside the insulating base body between the first terminal assembly and the second terminal assembly; and the signal connector further including:

two metal plates, inserted in the insulating base body and respectively in contact with the ground piece, wherein top portions of two metal plates are exposed outside the top surface of the insulating base body and electrically connected to corresponding first ground terminals respectively; bottom portions of the two metal plates are exposed outside the bottom surface of the insulating base body and electrically connected to corresponding second ground terminals respectively; therefore, the first ground terminals, the second ground terminals, and the ground piece get together to form a ground element of the signal connector.

14. The signal connector as claimed in claim 13, wherein rear ends of the two metal plates have a holding hole respectively and the ground piece has a protruding part at a location corresponding to each holding hole respectively; each protruding part can be inserted into the corresponding holding hole respectively so that the two metal plates are in contact with the ground piece.

15. The signal connector as claimed in claim 14, wherein the signal connector is a Type-C specification of Universal Serial Bus (USB).

* * * * *